US005537482A

United States Patent [19]

Janning

[11] Patent Number: 5,537,482

[45] Date of Patent: Jul. 16, 1996

[54] MAGNETIC, VARIABLE-VOLUME SOUND PRODUCING DEVICE

[75] Inventor: John L. Janning, Dayton, Ohio

[73] Assignees: JLJ, Inc., Dayton; Jay Cavender, Inc., Springboro, both of Ohio; part interest to each

[21] Appl. No.: 281,172

[22] Filed: Jul. 25, 1994

[51] Int. Cl.[6] ..... H04R 25/00

[52] U.S. Cl. ..... 381/198; 381/196; 381/203

[58] Field of Search ..... 381/196, 203, 381/198; 455/38.2

[56] References Cited

U.S. PATENT DOCUMENTS

| | | | |
|---|---|---|---|
| 1,560,779 | 11/1925 | Grierson . | |
| 1,600,980 | 9/1926 | Gerns . | |
| 1,609,834 | 12/1926 | Rollinson . | |
| 1,621,845 | 3/1927 | Koch . | |
| 2,805,332 | 9/1957 | Bell | 381/196 |
| 4,330,780 | 5/1982 | Masaki | 455/38.2 |

*Primary Examiner*—Forester W. Isen
*Assistant Examiner*—Duc Nguyen

[57] ABSTRACT

A magnetic and variable-volume sound producing device which comprises a housing member, a substantially planar acoustic-producing diaphragm supported along its peripheral edge by the housing, a spiral, multi-turn and electrically conductive coil fixedly secured to the diaphragm and adapted to be energized by an alternating voltage having a frequency within the range of approximately 100 Hz to 15,000 Hz to thereby cause the diaphragm to vibrate at a frequency determined by the applied alternating voltage in the presence of a magnetic field. A volume control permanent magnet is slidably mounted within the housing along a fixed predetermined path with respect to the coil and is connected to a manually operable lever means to be fixedly position at a predetermined physical location with respect to the coil along the predetermined path, whereby the volume of the audio output signal is determined by the physical position of the permanent magnet.

6 Claims, 2 Drawing Sheets

MAGNETIC, VARIABLE-VOLUME SOUND PRODUCING DEVICE

TECHNICAL FIELD

The present invention relates generally to audible sound producing devices and particularly to a new and improved magnetic, variable-volume sound producing device.

PRIOR ART

Magnetic, variable-volume sound producing devices have been well known for many years and have been employed in a variety of configurations and applications. However, in each of those particular sound producing devices which utilizes a fixed magnet coupled to an associated driving coil, the magnitude of the sound emanating from the output speaker, or diaphragm, thereof is a function of the energy supplied to the associated driving coil. This normally results in a magnetic, variable-volume sound producing device which is much more complicated and costly to produce than that of Applicant's in which there is utilized a movable magnet which is coupled to a planar coil driven diaphragm whereby the magnitude of the acoustic air, or sound, waves produced by the diaphragm is a function of the relative physical position between the magnet and the associated driving coil, thereby substantially simplifying the construction and cost of the sound producing device in a very unique manner.

SUMMARY OF THE INVENTION

In accordance with the present invention, there is provided a new and improved magnetic, variable-volume sound producing device which comprises a movable magnetic and a planar coil driven output diaphragm, whereby the audible sound produced by the diaphragm is a function of the relative physical position between the magnetic and the associated driving coil.

DESCRIPTION OF THE PREFERRED EMBODIMENT

Figure 1:
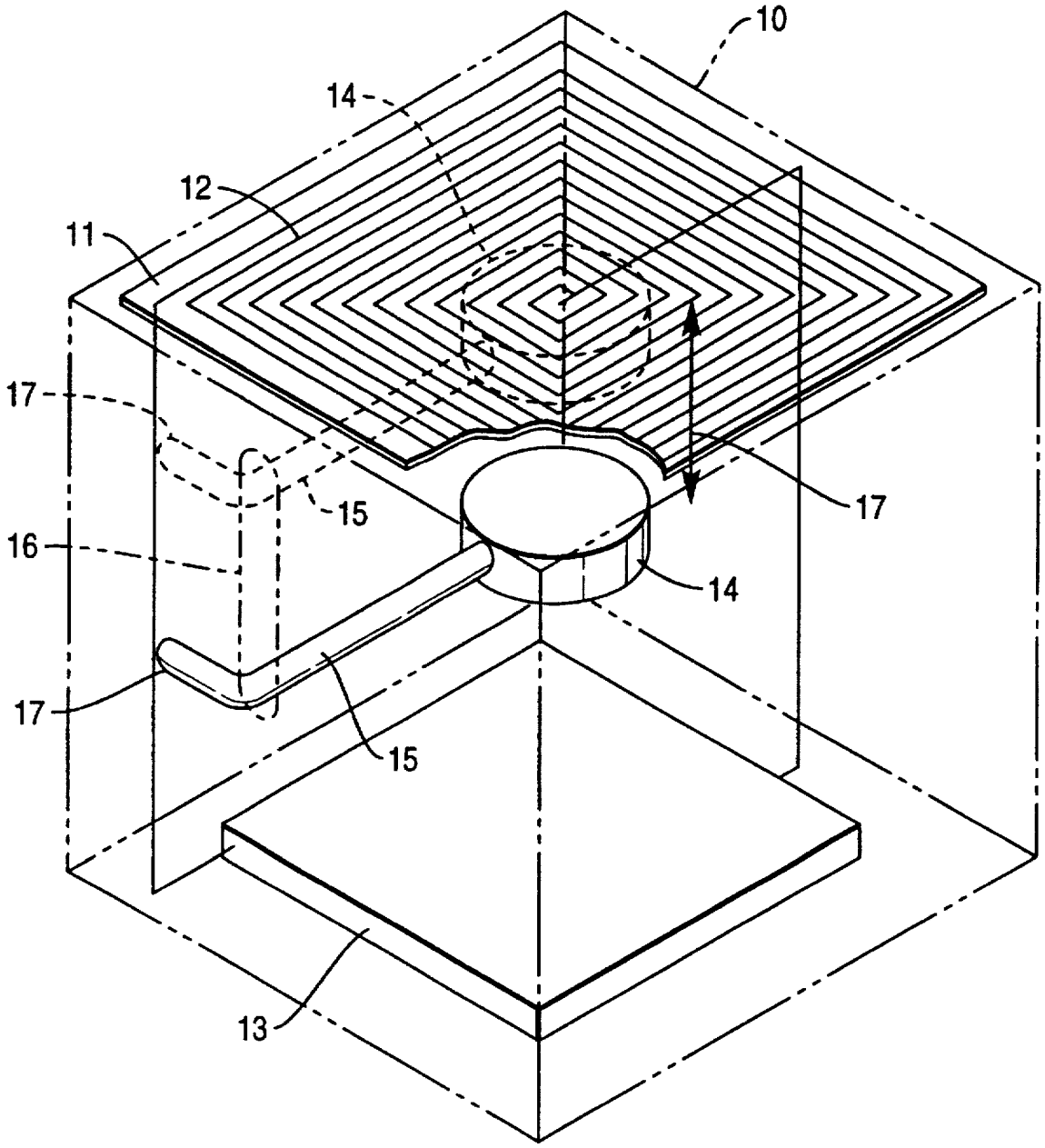
FIG. 1 is diagrammatic perspective view of a first embodiment of a magnetic, variable-volume sound producing device constructed in accordance with the present invention; and, FIG. 2 is diagrammatic perspective view of a second embodiment of a magnetic, variable-volume sound producing device constructed in accordance with the present invention.

With reference to FIG. 1 of the drawings, there is shown a diagrammatic perspective representation of a new and improved variable-volume sound producing device constructed in accordance with one aspect of the present invention.

Fixedly supported by and at the top of housing 10, and around its periphery, is a substantially flat or planar diaphragm 11 which may be constructed of any suitable plastic or other readily flexible material. A substantially flat or planar and multi-turn spiral coil 12 is suitably mounted or otherwise formed on or supported by diaphragm 11 by printed circuit or other well known techniques and is electrically energized by an alternating voltage generator which is chosen to be capable of energizing coil 12 with an alternating voltage in the audio frequency range of preferably from 100 to 15,000 Hz and which may be constructed in accordance with any of the many well known techniques. For example, a 125 turn thin film copper coil having a diameter in the order of from ½" to 1¼ and etched from an approximately 15 micron copper film attached to an approximately 0.002" polyimide film has been found to function quite satisfactorily.

A preferably round, relatively light weight and substantially flat-faced permanent magnet 14 is provided and is fixedly secured to one end of movable rod or arm 15, the opposite end of which extends through elongated slot 16 and beyond the side wall of housing 10. For example, a ⅜" diameter neodymium-iron-boron magnetic measuring approximately 2 kilogauss (using a Hall probe gaussmeter) has been found to produce satisfactory sound when in the vicinity of energizing coil 12. Fixedly secured to the opposite end of arm 15 is a manually operable control knob 17 which is adapted to be grasped by the operator to slide arm 15 up and down within slot 16 as indicated by the double-headed arrow 17 and to thereby fixedly secure the vertical or axial position of magnet 14 at any selected vertical location as determined by the length of slot 16.

In operation, when an alternating voltage in the order of from 6 to 15 volts and having a frequency from, say, 100 to 15,000 Hz is applied by generator 13 to coil 12 in the presence of the constant magnetic field produced by permanent magnet 14 which is placed near energized coil 12, the plastic diaphragm 11 will vibrate at the audio rate determined by the applied voltage and with an intensity, or volume, of the resulting vibration being a function of the distance of magnet 14 to coil 12. The closer magnet 14 is physically placed to coil 12, the louder the audible signal will be; conversely, the farther magnet 14 is physically placed from coil 12, the weaker the audible signal will be. It has been found that at a distance of approximately ¾", the sound is barely audible. However, a maximum sound output in the order of 107 decibels at 1000 Hz has been produced and functions quite satisfactorily.

Figure 2:
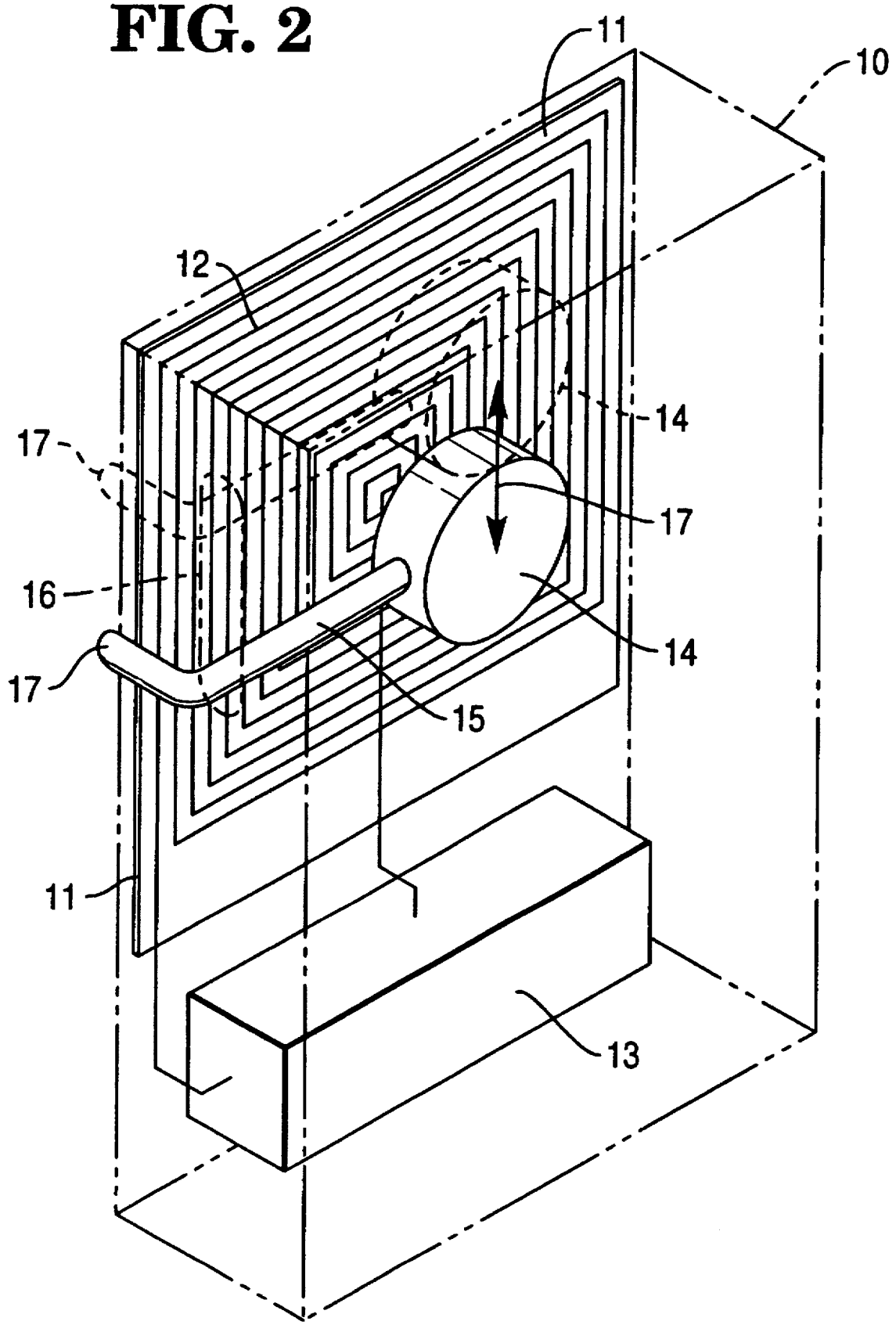

FIG. 2 illustrates a modified version of the above embodiment in that, in this particular embodiment diaphragm 11 and coil 12 are suitably mounted on the side wall of housing 10 whereby vertical movement of control knob causes permanent magnet 14 to move across coil 12 from the centermost portion thereof to the outermost portion thereof.

Contrasted with the first embodiment in which the volume is diminished when magnet 14 is moved away from coil 12, in the second embodiment depicted in FIG. 2, the volume is highest when magnet 14 is physically located over the center of coil 12 and diminishes when moved to the outside of coil 12.

Thus, in accordance with one aspect of the present invention, there is produced a new and improved magnetic, variable-volume sound producing device which is extremely simple in construction, very simple to operate even by an untrained operator, and yet is highly effective in producing an audible signal at the exact level preselected by the operator thereof.

Such simple and yet highly effective devices are particularly desirable and useful when used in connection with standard pocket size telephone pagers, or "beepers", where the volume of the output signal therefrom is of particular concern and sensitive when used in a closed, private environment such as in church, meetings, and the like.

Aside from the relatively low cost of the variable-volume sounder, another advantage is that it can also be used as a loudspeaker in radios or so-called "talking beepers".

Beepers or telephones have an audible "beep-beep" sounder device that alerts one to an incoming message. Most of present day units provide a constant volume for alerting the owner that there is an incoming signal. A volume control could be added at additional expense and space to these units, but this is unattractive cost-wise. In the variable-volume sounder, the only additional part that needs to be added is a cost effective means to move the already incorporated magnetic closer to, or farther from, the center of the energized coil in accordance with applicant's novel approach which is very simple and can be incorporated into existing units at minimal cost.

Further, in accordance with applicant's invention present day beeper owners now have the option of selecting an audible loud pitched series of beeps or a vibration that can be felt but not heard when a signal is incoming. In fact, in actual practice, a low volume audible signal is normally preferred. The present variable-volume sounder is capable of doing just that by the user simply adjusting the sound level from barely audible to over 100 decibels, if so designed into the electronics, by merely moving a lever or slide that is connected to the magnet.

In accordance with a further aspect of the present invention, the variable-volume sounder shown and described herein can also be used as the loudspeaker in a telephone or a so called "talking beeper" which are just coming onto the market but with certain limitations. One of these limitations is that the voice message is usually limited to approximately 10 seconds or less to keep "air time" low. This means that a person must have the volume turned up more than desired so that nothing is missed since these messages are not repeated unless the owner has purchased an additional "repeat signal" option at still further additional cost.

In accordance with the further aspect of applicant's invention, an integrated circuit record/playback chip (not shown) is incorporated into generator 13 in any well-known manner whereby the incoming voice signal is first recorded on the record/playback chip. Thereafter, by simply pressing a button on the beeper or telephone device, the message is played back as often as desired at no additional cost or charge to the owner thereof. Further, if the incoming voice signal is compressed on transmission and decompressed on playback, much more than ten seconds of information could be relayed in much less time that the existing ten seconds "air time". Since conventional record/playback chips normally hold twenty seconds of audio (128,000 bits/20 seconds=6.4 Khz.), a twenty second voice signal could be recorded in ten seconds and played back in the twenty second time frame without affecting the frequency response. Operation in this manner would then permit the owner to keep the volume at a lower level, knowing that the message is stored for retrieval at a later time and at a more comfortable and more private level. The message would remain stored on the chip until erased or until the next message was sent. No so-called "repeat signal" option would then be needed and longer messages could be sent and received.

The sound output of voice signals from the variable-volume sounder device in a talking beeper, as opposed to the "beep-beep" beep sound, is manipulated internally by the electronics. When on standby, the sounder is connected to the beep electronics. When a message is being sent, the electronics automatically connect the variable-volume sounder to the receiver output to act as a loudspeaker. The speaker volume for the voice sound output is adjusted in the same manner as the volume for the beeper signal by sliding the magnet of the variable-volume sounder closer to, or farther away from, the center of the energized coil, all at minimal added cost.

Having so described and illustrated the principles of my invention in a preferred embodiment, it is intended, therefore, in the annexed claims, to cover all such changes and modifications as may fall within the scope and spirit of the following claims:

I claim:

1. A variable-volume sound producing device comprising:

an audio frequency generator for producing an audio output signal;

a substantially planar diaphragm having a spiral, multi-turn and electrically conductive coil fixedly disposed thereon which is functionally independent of said audio frequency generator;

means for operatively coupling said audio output signal to said cofi to cause said diaphragm to vibrate, in the presence of a magnetic field, and dynamically reproduce audible sound in accordance with said audio output signal;

a permanent magnet physically positionable along a fixed and predetermined path contiguous to said coil;

and, manually operable means for physically positioning said magnet at predetermined positions along said path to independently change the volume of said reproduced audible sound without affecting the characteristics of the output of said audio frequency generator.

2. In an audio signal generator which includes as its major functional components, means for receiving an incoming signal, and means for producing therefrom an audio output signal, the combination comprising:

a substantially planar diaphragm having a spiral, multi-turn and electrically conductive coil fixedly disposed on the surface thereof and functionally independent of said audio signal generator;

means for operatively coupling said audio output signal to said cofi to cause said diaphragm to vibrate in the presence of a magnetic field to dynamically reproduce audible sound;

a permanent magnet physically movable along a fixed and predetermined path contiguous with said coil;

and, manually operable means for positioning said magnet at a predetermined position along said path to change the volume of said audible sound without affecting the characteristics of the output of said audio signal generator.

3. A variable-volume sound producing device comprising:

a housing member;

means for generating a sound producing signal having a frequency within the audible range;

a substantially planar acoustic-producing diaphragm supported along its peripheral edge within said housing member and having a spiral, multi-turn and electrically conductive coil fixedly disposed thereon which is functionally independent of said sound producing signal generating means;

means electrically coupling the output of said sound producing signal generating means to said coil for energizing said coil with a sound producing signal having a frequency within the audible range to cause said diaphragm to physically vibrate in the presence of a magnetic field at a frequency determined by said sound producing signal;

a permanent magnet slidably mounted within said housing along a fixed predetermined path with respect to said coil; and, manually operable means adapted to fixedly position said magnet at a predetermined physical location with respect to said coil along said predetermined path to change the volume of the audible output from said vibrating diaphragm without significantly affecting the characteristics of the output from said sound producing signal generating mean.

4. Apparatus in accordance with claim 1 in which said magnet is fixedly secured at predetermined radial positions along said path.

5. Apparatus in accordance with claim 1 in which said magnet is fixedly secured at predetermined axial positions along said path.

6. Apparatus in accordance with claim 1, wherein said input signal is stored on an integrated circuit chip prior to said audio output signal being derived therefrom and applied to said coil.

* * * * *